US009949051B2

(12) United States Patent
Higgins et al.

(10) Patent No.: US 9,949,051 B2
(45) Date of Patent: Apr. 17, 2018

(54) EMBEDDED AND PRINTED ACOUSTIC PORT

(71) Applicant: Starkey Laboratories, Inc., Eden Prairie, MN (US)

(72) Inventors: Sidney A. Higgins, Maple Grove, MN (US); John Becker, Delano, MN (US); Thomas Bartosh, Minneapolis, MN (US); Joel Erdman, Waconia, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 15/172,933

(22) Filed: Jun. 3, 2016

(65) Prior Publication Data

US 2016/0360333 A1 Dec. 8, 2016

Related U.S. Application Data

(60) Provisional application No. 62/171,027, filed on Jun. 4, 2015.

(51) Int. Cl.

| | |
|---|---|
| ***H04R 25/00*** | (2006.01) |
| ***H04R 31/00*** | (2006.01) |
| ***H04R 19/04*** | (2006.01) |
| ***H04R 1/04*** | (2006.01) |

(52) U.S. Cl.

CPC ..... *H04R 31/006* (2013.01); *H04R 1/04* (2013.01); *H04R 19/04* (2013.01); *H04R 31/003* (2013.01); *H04R 25/604* (2013.01); *H04R 2201/003* (2013.01); *H04R 2201/029* (2013.01)

(58) Field of Classification Search

CPC ..... H04R 31/006; H04R 1/04; H04R 19/04

See application file for complete search history.

(56) References Cited

U.S. PATENT DOCUMENTS

| | | | | |
|---|---|---|---|---|
| 8,339,798 | B2 | 12/2012 | Minoo et al. | |
| 2008/0165305 | A1* | 7/2008 | Miyamoto | G02F 1/133604 349/58 |
| 2010/0128914 | A1 | 5/2010 | Khenkin | |
| 2013/0343564 | A1* | 12/2013 | Darlington | H04R 1/1016 381/74 |
| 2014/0044297 | A1 | 2/2014 | Loeppert et al. | |
| 2014/0205127 | A1 | 7/2014 | Khenkin et al. | |

OTHER PUBLICATIONS

"European Application Serial No. 16172994.2, Extended European Search Report dated Oct. 18, 2016", 9 pgs.

"European Application Serial No. 16172994.2, Response filed Jun. 7, 2017 to Extended European Search Report dated Oct. 18, 2016", 27 pgs.

* cited by examiner

*Primary Examiner* — Simon King

(74) *Attorney, Agent, or Firm* — Schwegman Lundberg & Woessner, P.A.

(57) ABSTRACT

Described are techniques for creating acoustic inlet manifolds for a microphone that utilize existing flex or printed circuit board (PCB) technology to create an ultra-low profile manifold. The described techniques: take advantage of the ability to allow reflow connection. By embedding an acoustic path between the layers or creating an acoustic path on the surface of a flex or PCB assembly, the microphone can be reflowed onto the manifold assembly.

8 Claims, 4 Drawing Sheets

EMBEDDED AND PRINTED ACOUSTIC PORT

PRIORITY CLAIM

This patent application claims the benefit of U.S. Provisional Patent Application No. 62/171,027 filed Jun. 4, 2015, which is incorporated by reference herein in its entirety.

FIELD OF THE INVENTION

This invention pertains to electronic hearing aids and methods for their construction.

BACKGROUND

Hearing aids are electronic instruments that compensate for hearing losses by amplifying sound. The electronic components of a hearing aid include a microphone for receiving ambient sound, an amplifier for amplifying the microphone signal in a manner that depends upon the frequency and amplitude of the microphone signal, a speaker for converting the amplified microphone signal to sound for the wearer, and a battery for powering the components.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Figure 1:
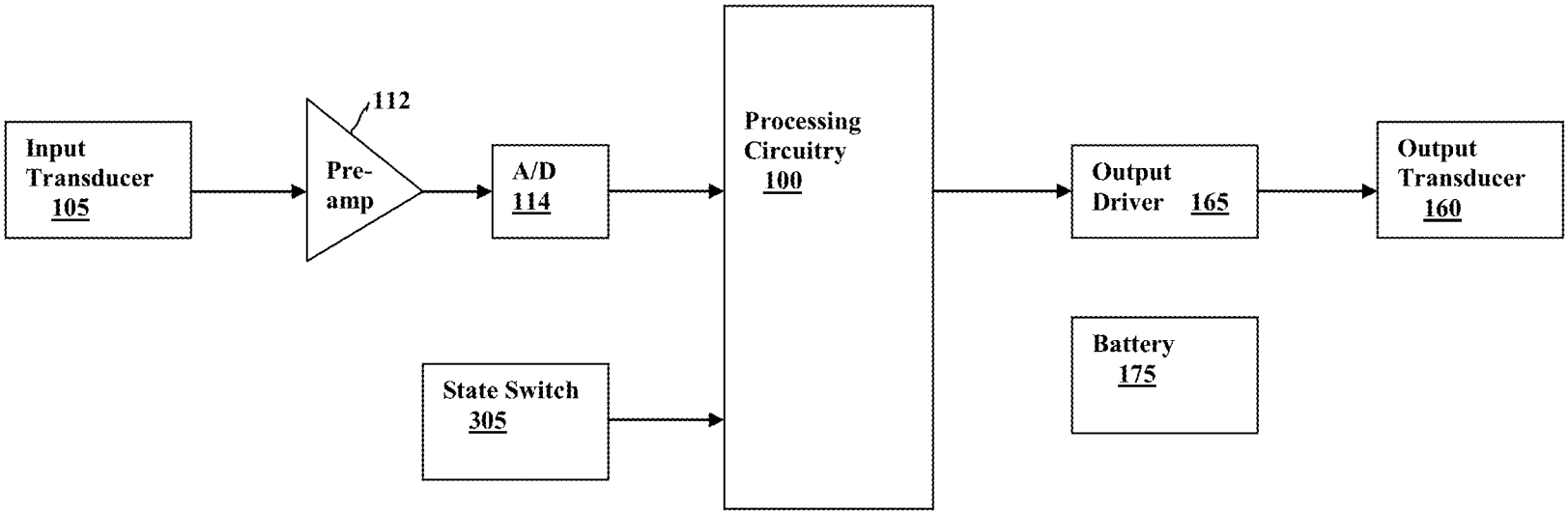
FIG. 1 shows the basic electronic components of an example hearing aid according to one embodiment.

FIG. 1 illustrates the basic functional components of an example hearing aid according to one embodiment. The electronic circuitry of a typical hearing aid is contained within a housing that is commonly either placed in the external ear canal or behind the ear. A microphone or input transducer 105 receives sound waves from the environment and converts the sound into an input signal. After amplification by pre-amplifier 112, the input signal is sampled and digitized by A/D converter 114 to result in a digitized input signal. The device's processing circuitry 100 processes the digitized input signal in a manner that compensates for the patient's hearing deficit. The output signal is then passed to an output driver 165 that drives an output transducer 160 or receiver for converting the output signal into an audio output. A battery 175 supplies power for the electronic components of the hearing aid.

The microphone 105 may be a MEMS (microelectromechanical system) microphone that forms part of a microphone assembly that is integrated with other components within the hearing aid housing. The completed microphone assembly includes one or more acoustic pathways or ports by which ambient sound reaches the microphone.

Adding acoustic ports to MEMS (microelectromechanical system) microphones often results in less than optimal positioning and placement of the transducer due to the location of the solder pads and orientation of the port. Traditional methods of porting often make inclusion of these microphones into custom products impractical due to the additional size difficulty of sealing without inducing slit leaks. Reflow soldering of vertical spouts or adhesive bonding of horizontal metal manifolds may be performed. However, reflow soldering of spouts results in the wire solder pads still being on the wrong side of the transducer, and adhesive bond lines are very thin which limits the choice of adhesives due to outgassing. Also, these manifolds must be placed and bonded one at a time.

Described herein are techniques for creating acoustic inlet manifolds for a microphone that utilize existing flex/PCB technology to create an ultra-low profile manifold (e.g., 0.2 to 0.1 mm thick). The described techniques: take advantage of the MEMS ability to allow reflow connection, create the opportunity to customize wire pad location, create the opportunity to "tune" the acoustic channel, make matched pairs modules possible, protect the microphone's motor from degradation due to spatter and other manufacturing debris, and provide an electrically insulated barrier (should a slit microphone be desired).

By embedding an acoustic path between the layers or creating an acoustic path on the surface of a flex or PCB assembly, the microphone can be reflowed onto the manifold assembly. Other advantages include the following. The process can be done while the manifolds are in panel form so automation is possible to lower costs. The same manifold assembly may also relocate the wire solder pads making customization possible on a stock part. The +/−pads may be relocated to achieve greater separation may restrict dendrite formation. The microphone diaphragm is protected from solder flux and spatter. Port dimensions may be easily varied by varying copper thickness and shape to create a specific acoustic response. Specific acoustic responses can include but are not limited to: unique front microphone and rear microphone responses (this could be used to balance additional porting added after this assembly), shifting and adjusting the resonant peak (e.g., dampening the resonant peak), reducing high frequency sensitivity outside the band of interest and similarly reducing sensitivity to ultrasonic noise. The techniques may be incorporated into a flex or PCB (printed circuit board) design including the microphone and other components (including but not limited to: microprocessors, capacitors, resistors, inductors, memory). Previous solutions add size, can be inconsistent, do not address pad/spout location in one step, and require expensive tooling to create the spouts/manifolds. The Kapton and or PCB materials will also allow isolation of the assembly from battery contacts.

Figure 2A:
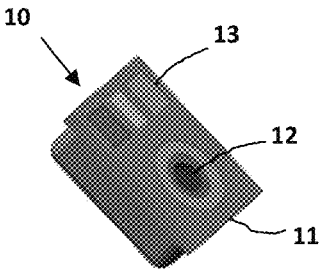
FIGS. 2A through 2C illustrate an embodiment with a PCB-based design.
Figure 2B:
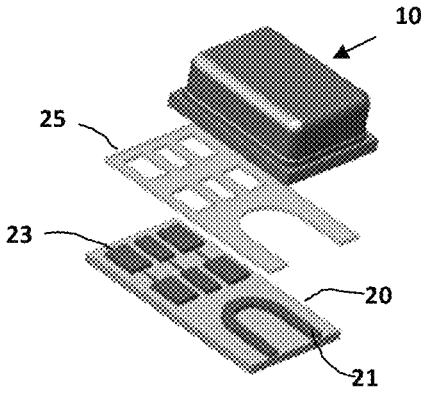
Figure 2C:
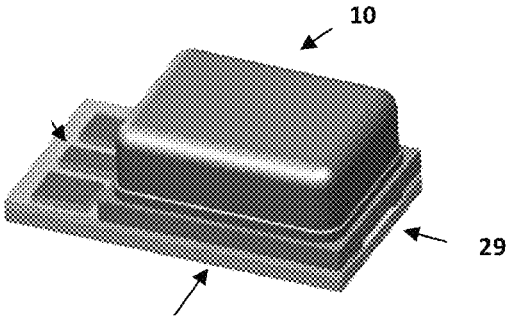

FIGS. 2A through 2C illustrate an embodiment with a PCB-based design. FIG. 2A depicts a MEMS microphone 10 having a planar surface 11 with solder pads 13 and an acoustic inlet port 12 on the same side of the planar surface. FIG. 2B shows a PCB manifold with printed traces and solder mask construction. The PCB 20 has a printed trace 21

(e.g., a copper trace), which will form part of the acoustic inlet manifold when the microphone assembly is constructed, and solder pads 23. The microphone 10 is stacked atop the PCB 20 with solder mask 25 interposed therebetween. FIG. 2C shows the completed microphone assembly where an acoustic inlet port 29 is created between the microphone 10, the printed trace 21, and the solder-mask 25 on the PCB 20. The acoustic inlet port dimensions and shape may be controlled by the thicknesses of the solder mask and the printed trace. The acoustic inlet port is not embedded between layers of the PCB 20 board, so there is not the problem of adhesive squishing into the port.

Figure 3A:
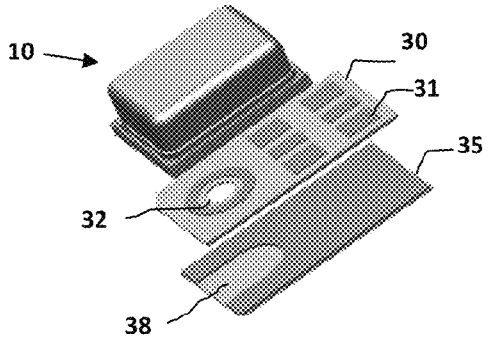
FIGS. 3A and 3B illustrate an embodiment utilizing a flex based design.
Figure 3B:
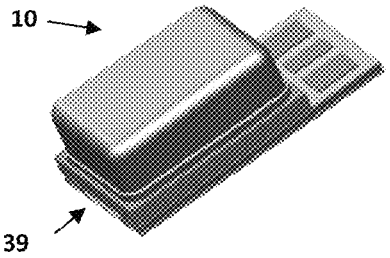

FIGS. 3A and 3B illustrate another embodiment utilizing a flex based design. FIG. 3A shows a microphone 10 and a flex board made up of a layer 30 and a layer 35. The layer 30 has solder pads 31 thereon and an aperture 32 which will align with the acoustic inlet port 12 of the microphone 10 when the microphone assembly is completed. The layer 35 has a cavity 38 therein so that an acoustic inlet manifold 39 is formed when the layers are stacked. When the microphone 10 is stacked atop the flex board as shown in FIG. 3B, the acoustic inlet manifold 29 is continuous with the acoustic inlet port of the microphone. Note that the acoustic inlet manifold may be extended beyond the microphone in this design. It may be difficult to keep adhesive out of the manifold because the manifold is embedded between layers of the flex that may be joined together with adhesive. To deal with this problem, two independent flex boards may be created which are then reflowed together. This eliminates the adhesive layer but adds an additional step. The flex design may afford greater flexibility in module design and inclusion in BTE's.

Figure 4:
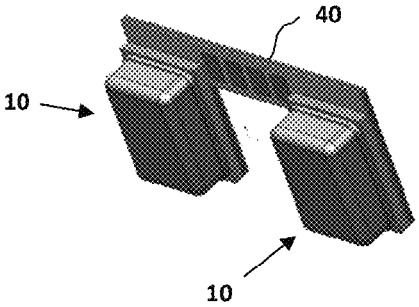
FIGS. 4-6 show additional embodiments.
Figure 5:
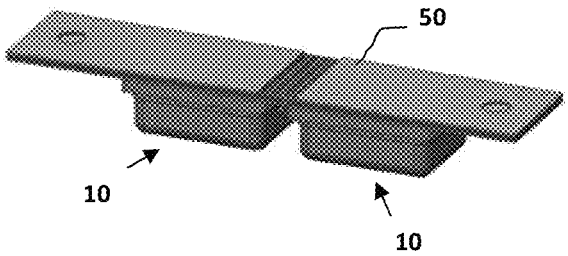
Figure 6:
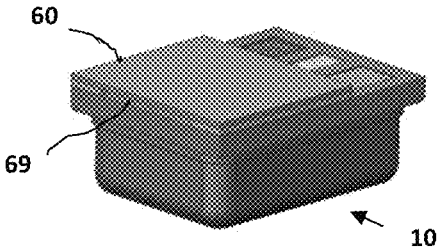

FIGS. 4-6 show additional embodiments. In FIG. 4, a pair of microphones 10 are assembled on a board 40 having acoustic inlet manifolds for each microphone. In FIG. 5, a pair of microphones 10 are assembled on a board 50 having acoustic inlet manifolds for each microphone that extend beyond the microphones. FIG. 6 shows a polymer or flex based thin manifold 60 adheared by adhesive or double stick tape to the microphone 10 to create an acoustic inlet manifold 69. Note that this embodiment does not relocate the solderpads and could be reflowed as well.

EXAMPLE EMBODIMENTS

In Example 1, a microphone assembly for a hearing assistance device, comprises: a microphone having a planar surface with an acoustic inlet port; a printed circuit board (PCB) having a printed trace connecting two points on an edge of the PCB; a solder mask; wherein the microphone is stacked on the printed circuit board with the solder mask interposed therebetween; and, wherein the printed trace travels around the acoustic inlet port so that an acoustic inlet manifold continuous with the acoustic inlet port is created between the microphone, the solder mask, and the printed trace.

In Example 2, the subject matter of Example 1 or any of the Examples herein may optionally include wherein the solder mask has a cut-out with a border that matches the shape of the printed trace.

In Example 3, the subject matter of Example 1 or any of the Examples herein may optionally include wherein the cut-out and printed trace are U-shaped.

In Example 4, the subject matter of Example 1 or any of the Examples herein may optionally include wherein the cut-out and printed trace are rectangularly shaped.

In Example 5, the subject matter of Example 1 or any of the Examples herein may optionally include wherein the planar surface has solder pads on the same side as the acoustic inlet port.

In Example 6, a microphone assembly, comprises: a microphone having a planar surface with an acoustic inlet port; a flex board comprising a first layer and a second layer and having slit at one edge that is continuous with a cavity between the first and second layers; wherein the first layer has solder pads and an aperture; and, wherein the planar surface of the microphone is stacked atop the first layer of the flex board so that the acoustic inlet port is continuous with the aperture and so that the cavity between the first and second layers forms an acoustic inlet manifold for the microphone.

In Example 7, the subject matter of Example 6 or any of the Examples herein may optionally include wherein the aperture of the first layer aligns with the acoustic inlet port of the microphone.

In Example 8, the subject matter of Example 6 or any of the Examples herein may optionally include wherein the second layer has a cavity therein to form the acoustic inlet manifold when the first and second layers are stacked.

In Example 9, the subject matter of Example 6 or any of the Examples herein may optionally include wherein the first and second layers are joined together with adhesive.

In Example 10, the subject matter of Example 6 or any of the Examples herein may optionally include wherein the first and second layers are reflowed together.

In Example 11, a method for constructing a microphone assembly, comprises: disposing a microphone having a planar surface with an acoustic inlet port on a printed circuit board (PCB), wherein the PCB has a printed trace connecting two points on an edge of the PCB; interposing a solder mask between the PCB and the microphone; wherein the printed trace travels around the acoustic inlet port so that an acoustic inlet manifold continuous with the acoustic inlet port is created between the microphone, the solder mask, and the printed trace.

In Example 12, the subject matter of Example 11 or any of the Examples herein may optionally include wherein the solder mask has a cut-out with a border that matches the shape of the printed trace.

In Example 13, the subject matter of Example 11 or any of the Examples herein may optionally include wherein the cut-out and printed trace are U-shaped.

In Example 14, the subject matter of Example 11 or any of the Examples herein may optionally include wherein the cut-out and printed trace are rectangularly shaped.

In Example 15, the subject matter of Example 11 or any of the Examples herein may optionally include wherein the planar surface has solder pads on the same side as the acoustic inlet port.

In Example 16, a method for constructing a microphone assembly, comprises: forming a flex board by joining a first layer and a second layer together, wherein the flex board has a slit at one edge that is continuous with a cavity between the first and second layers; disposing a microphone having a planar surface with an acoustic inlet port on the flex board; and, wherein the microphone is disposed on the flex board by stacking the planar surface of the microphone atop the first layer of the flex board so that the acoustic inlet port is continuous with an aperture of the first layer and so that the cavity between the first and second layers forms an acoustic inlet manifold for the microphone.

In Example 17, the subject matter of Example 16 or any of the Examples herein may optionally include wherein the aperture of the first layer aligns with the acoustic inlet port of the microphone.

In Example 18, the subject matter of Example 16 or any of the Examples herein may optionally include wherein the second layer has a cavity therein to form the acoustic inlet manifold when the first and second layers are stacked.

In Example 19, the subject matter of Example 16 or any of the Examples herein may optionally include wherein the first and second layers are joined together with adhesive.

In Example 20, the subject matter of Example 16 or any of the Examples herein may optionally include wherein the first and second layers are reflowed together.

In Example 21, a hearing assistance device comprises: a microphone assembly for converting an audio input into an input signal; processing circuitry for processing the input signal to produce an output signal in a manner that compensates for a patient's hearing deficit; a speaker for converting the output signal into an audio output; a battery for supplying power to the hearing aid; and wherein the microphone assembly is constructed as set forth in any of the Examples herein.

Hearing assistance devices typically include at least one enclosure or housing, a microphone, hearing assistance device electronics including processing electronics, and a speaker or "receiver." Hearing assistance devices may include a power source, such as a battery. In various embodiments, the battery may be rechargeable. In various embodiments multiple energy sources may be employed. It is understood that in various embodiments the microphone is optional. It is understood that in various embodiments the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is further understood that different hearing assistance devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A microphone assembly for a hearing assistance device, comprising:

a microphone having a planar surface with an acoustic inlet port;

a printed circuit board (PCB) having a printed trace connecting two points on an edge of the PCB;

a solder mask having a cut-out with a border that matches the shape of the printed trace;

wherein the microphone is stacked on the printed circuit board with the solder mask interposed therebetween; and, wherein an acoustic inlet manifold continuous with the acoustic inlet port is created between the microphone, the cut-out of the solder mask, and the printed trace.

2. The microphone assembly of claim 1 wherein the cut-out and printed trace are U-shaped.

3. The microphone assembly of claim 1 wherein the cut-out and printed trace are rectangularly shaped.

4. The microphone assembly of claim 1 wherein the planar surface has solder pads on the same side as the acoustic inlet port.

5. A method for constructing a microphone assembly, comprising:

disposing a microphone having a planar surface with an acoustic inlet port on a printed circuit board (PCB);

wherein the PCB has a printed trace connecting two points on an edge of the PCB;

interposing a solder mask between the PCB and the microphone, the solder mask having a cut-out with a border that matches the shape of the printed trace;

wherein an acoustic inlet manifold continuous with the acoustic inlet port is created between the microphone, the cut-out of the solder mask, and the printed trace.

6. The method of claim 5 wherein the cut-out and printed trace are U-shaped.

7. The method of claim 5 wherein the cut-out and printed trace are rectangularly shaped.

8. The method of claim 5 wherein the planar surface has solder pads on the same side as the acoustic inlet port.

* * * * *